US010472036B2

(12) United States Patent
Spengler et al.

(10) Patent No.: US 10,472,036 B2
(45) Date of Patent: Nov. 12, 2019

(54) MOUNTING FOR BOAT DRIVE

(71) Applicant: Torqeedo GmbH, Gilching (DE)

(72) Inventors: Anton Spengler, Gilching (DE); Frank Despineaux, Gilching (DE)

(73) Assignee: Torqeedo GmbH, Gilching (DE)

( * ) Notice: Subject to any disclaimer, the term of this patent is extended or adjusted under 35 U.S.C. 154(b) by 0 days.

(21) Appl. No.: 15/594,147

(22) Filed: May 12, 2017

(65) Prior Publication Data

US 2017/0327195 A1 Nov. 16, 2017

(30) Foreign Application Priority Data

May 13, 2016 (EP) ..... 16001097

(51) Int. Cl.

| | |
|---|---|
| ***B63H 5/125*** | (2006.01) |
| ***B63H 21/17*** | (2006.01) |
| ***B63H 21/30*** | (2006.01) |
| ***B63H 21/00*** | (2006.01) |
| ***B63H 5/07*** | (2006.01) |
| ***B63H 25/42*** | (2006.01) |

(52) U.S. Cl.

CPC ..... *B63H 5/125* (2013.01); *B63H 21/17* (2013.01); *B63H 21/24* (2013.01); *B63H 21/30* (2013.01); *B63H 2005/075* (2013.01); *B63H 2005/1258* (2013.01); *B63H 2021/307* (2013.01); *B63H 2025/425* (2013.01)

(58) Field of Classification Search

CPC ..... B63H 5/125; B63H 21/30; B63H 21/17; B63H 21/24; B63H 2005/075; B63H 2025/425; B63H 2021/307; B63H 2005/1258

See application file for complete search history.

(56) References Cited

U.S. PATENT DOCUMENTS

| | | | | |
|---|---|---|---|---|
| 3,685,481 A | | 8/1972 | Mansell | |
| 4,226,206 A | * | 10/1980 | Wilson | B63H 20/04 248/640 |
| 4,529,386 A | * | 7/1985 | Smith | B63H 20/04 440/54 |
| 4,734,066 A | | 3/1988 | Burgess | |

(Continued)

FOREIGN PATENT DOCUMENTS

JP 2009-90961 A 4/2009

*Primary Examiner* — Anthony D Wiest

(74) *Attorney, Agent, or Firm* — Crowell & Moring LLP

(57) ABSTRACT

A boat drive for a boat having a boat hull with a bottom. The boat drive includes an underwater pod; an electric motor disposed in the underwater pod, the electric motor driving, via a drive shaft, a propeller attached to the underwater pod; and an electrical supply line for supplying energy to the electric motor. The boat drive further includes an inner tube connected to the underwater pod and displaceably disposed in an outer tube, wherein the electrical supply line is routed through the inner tube. The boat drive further includes a mounting body attachable to the bottom of the boat hull, wherein the outer tube is passed through the mounting body. At least one annular sealing element is disposed between the inner and outer tubes, wherein the at least one annular sealing element seals the inner tube and the outer tube in a radial direction relative to the longitudinal axis of the inner tube.

14 Claims, 1 Drawing Sheet

(56) References Cited

U.S. PATENT DOCUMENTS

| | | | | | |
|---|---|---|---|---|---|
| 5,074,811 | A | * | 12/1991 | Crisman | B60L 8/00 440/6 |
| 5,331,914 | A | * | 7/1994 | Salmons | B63B 35/76 114/125 |
| 2001/0029133 | A1 | | 10/2001 | Breems | |
| 2015/0050846 | A1 | | 2/2015 | Case | |

* cited by examiner

MOUNTING FOR BOAT DRIVE

This application claims the priority of European Patent Document No. EP 16 001 097.1, filed May 13, 2016, the disclosure of which is expressly incorporated by reference herein.

BACKGROUND AND SUMMARY OF THE INVENTION

The disclosure relates to a boat drive for a boat, comprising an underwater pod in which is disposed an electric motor which drives, via a drive shaft, a propeller attached to the underwater pod, wherein the electric motor can be supplied with energy via at least one electrical supply line. The disclosure further relates to a boat with such a boat drive.

The disclosure further relates to a boat drive with an underwater pod mounted below the boat hull. In the underwater pod an electric motor is provided which drives at least one propeller. The electric motor is usually supplied with energy via a battery or an accumulator which is disposed in the interior of the boat hull.

The electrical supply lines must therefore be routed from the interior of the boat to the outside. For this purpose, in the prior art an aperture is introduced into the bottom of the boat hull and the supply lines are routed through the aperture. The underwater pod is usually attached to the bottom with screwed connections. A sealing agent is then applied to the points of connection between the bottom of the boat hull and the underwater pod, and to the aperture for the power supply lines, in order to prevent penetration of water into the interior of the boat.

This design has the disadvantage, however, that the underwater pod cannot readily be removed from the boat hull. Inspections or repairs to the underwater pod or electric motor thus involve considerable effort and/or expense.

An object of the present disclosure is thus to provide a boat drive that can be demounted easily and quickly from the boat hull, while at the same time sealing or bonding is possible with boat hulls, which typically differ greatly from each other and are curvilinear. A boat with such a boat drive is further to be provided.

At least these objects are achieved by a boat drive of the type described at the outset, which is characterized in that an inner tube is connected with the underwater pod, and in that the electrical supply line is routed through the inner tube. A mounting body is further provided, which can be attached to the bottom of the boat hull, wherein an outer tube is passed through the mounting body. The inner tube is displaceably disposed in the outer tube, wherein between the inner tube and the outer tube an annular sealing element is provided, which seals the inner tube and the outer tube in a radial direction relative to the longitudinal axis of the inner tube.

A boat according to at least one embodiment has such a boat drive, wherein the mounting body is attached in a waterproof manner to the bottom of the boat hull.

At least one embodiment proposes the attachment of a mounting body with an outer tube to the boat hull in a waterproof manner. For this purpose an aperture is introduced in the bottom of the boat hull, through which the outer tube and/or the inner tube are inserted. The outer tube is connected with the mounting body in a waterproof manner. The mounting body can have a plate-shaped design, so that a relatively large contact surface is formed between the mounting body and the bottom of the boat hull, and as stable a connection as possible can be produced between the mounting body and the bottom.

The outer tube is preferably permanently connected with the mounting body, i.e. the connection cannot be released without destroying the outer tube or the mounting body. The outer tube and the mounting body can for example be welded, bolted or bonded to each other.

The mounting body is connected with the bottom of the boat hull in a waterproof manner. This connection can be produced for example by a screwed connection or by a welded or bonded connection. A screwed connection between the mounting body and the bottom is usually suitable for this purpose. To provide waterproofing, the point of connection between the mounting body and the bottom of the boat hull is for example sealed or bonded with sealing agent and/or adhesive. This point of connection is constantly exposed to the water surrounding the boat hull, and must therefore have a good and long-lasting seal.

The boat drive according to at least one embodiment can be attached irrespective of the design, shape and configuration of the bottom of the boat hull. It is only necessary to provide an aperture in the bottom through which the outer tube and/or the inner tube can be passed, and to provide any necessary fastening elements such as for example screws. The quality of the seal between the mounting body and the bottom does not depend on the thickness of the boat bottom. In addition, it is not essential for the boat bottom to be flat at the attachment point. A good and long-lasting seal and attachment can also be achieved if the boat's bottom, i.e. the boat's hull, has a curved shape. The invention further allows attachment at positions on the boat bottom where frames or reinforcing ribs are disposed. Boats typically have a longitudinal rib in their exact middle, the so-called keel stringer. Attachment at this point also presents no problems according to at least one embodiment.

The mounting body can be mounted on the boat hull such that the mounting body is at least in part, or entirely, disposed inside the boat hull.

In at least one embodiment, the mounting body is mounted on the boat hull such that the mounting body is at least in part, or entirely, disposed outside the boat hull.

Finally the mounting body can also be connected with the boat hull such that an interior part of the mounting body is disposed inside the boat hull and an exterior part of the mounting body is disposed outside the boat hull.

According to at least one embodiment, the boat drive is divided into two parts, one comprising the mounting body with the outer tube, and the other comprising the underwater pod with the inner tube, which are connected with each other such that the electrical connecting line from the interior of the underwater pod can be routed into the inner tube. In order to connect the two parts of the boat drive, the inner tube with the underwater pod can be inserted into the outer tube. The annular gap between the inner tube and the outer tube is sealed by means of one or more annular sealing elements, so that no water can penetrate into the interior of the boat through the annular gap. In a preferred embodiment, the annular sealing element is designed as an O-ring.

The sealing element or elements seal the inner tube and outer tube in a radial direction. "Radial" here refers to a direction perpendicular to the longitudinal axis of the inner tube and/or the outer tube. The inner tube and the outer tube run parallel to each other, and the sealing element is disposed between the two tubes. The inner tube and the outer tube are thus displaceable relative to each other in the axial direction, i.e. in their longitudinal direction, wherein the annular gap between the two tubes remains sealed at all times. This significantly facilitates the assembly of the two parts of the boat drive, namely the mounting body with the outer tube and the underwater pod with the inner tube, since it is not necessary to keep the two tubes in a precise position relative to each other in order to prevent leaks.

The outer tube additionally provides a good guideway for the inner tube, with the result that the inner tube with the underwater pod is secured against tilting.

The inner tube and underwater pod can also be secured against slipping out of the outer tube. This securing can be achieved for example by means of one or more screws, sleeves, bolts and/or pins. The securing can be both inside the boat hull and outside the boat hull.

The underwater pod can be mounted such that it is pivotable relative to the boat hull, in particular pivotable through 360°, or rigidly mounted.

In at least one embodiment, two or more, in particular four, sealing elements are provided. It is particularly expedient for at least one of the sealing elements to be in contact with the first end piece of the outer tube and at least one of the sealing elements to be in contact with the second end piece of the outer tube. In each case, the first end piece and the second end piece of the outer tube should here comprise in particular a third, a fourth, a fifth, an eighth or a tenth part of the length of the outer tube.

In at least one embodiment, the outer tube can also be passed though the mounting body such that, after attachment of the mounting body to the boat hull, an inner portion of the outer tube is disposed within the boat hull and an outer portion of the outer tube is disposed outside the boat hull. In this case at least one sealing element can be provided in the area of the inner portion of the outer tube, and at least one sealing element can be provided in the area of the outer portion of the outer tube. One of the sealing elements is then disposed inside the boat hull, and one of the sealing elements is disposed outside the boat hull. Advantageously, two sealing elements are provided in contact with the inner portion of the outer tube, and two sealing elements are provided in contact with the outer portion of the outer tube.

The underwater pod is a substantially streamlined housing in which an electric motor which drives a drive shaft is provided. The drive shaft passes through the wall of the underwater pod and turns a propeller disposed outside the underwater pod. The electric motor is supplied with energy from a battery or an accumulator. For this purpose the electric motor is connected in a current-conducting manner with the battery or accumulator via one or more electrical supply lines. Control lines for controlling the electric motor can also be provided.

The electrical supply line and any control lines must therefore be routed from the electric motor disposed in the underwater pod into the interior of the boat. For this purpose the inner tube and the underwater pod are connected with each other such that a passageway is created from the interior of the underwater pod into the interior of the inner tube. For example the inner tube protrudes through an aperture in the wall of the underwater pod into the interior of the underwater pod. It is also possible to provide an intermediate element, or a spacer, which has a hollow space that connects with both the interior of the underwater pod and the inner tube.

The electrical supply lines are routed from the underwater pod through the inner tube into the interior of the boat. The electrical supply lines (including any control lines) are advantageously provided with a plug connection which can be disconnected or reconnected. The plug connector is advantageously provided on the portion of the supply line that has been fed through the inner tube and is disposed in the interior of the boat.

If the underwater pod needs to be removed from the boat, for example in order to repair or inspect the electric motor, the electrical connection can be simply disconnected by unplugging the plug connection.

In order for the electric motor, the underwater pod or other connected parts to be maintained or repaired, the underwater pod together with the inner tube can easily be separated from the mounting body and removed, without damaging the sealing or bonding on the boat itself.

In order to close the outer tube in the event of lengthy maintenance or repair work, the outer tube can be closed with a specially manufactured closing element ("stopper"), which has the same type of sealing elements as the inner tube. By this means, even if a lengthy repair of the drive is necessary, the boat can quickly—possibly with the aid of an auxiliary drive such as an out-board motor—be made ready for continued use and refloated. Annoying idle periods in a dry dock can thereby be avoided. It is also possible to use a replacement drive (underwater pod and inner tube) in the event of a repair, and by this means reduce downtime to a minimum.

The invention and further advantageous aspects of the invention are explained in greater detail by way of example hereinafter with the aid of the schematic drawings. Other features and advantages will become apparent from the following more detailed description, taken in conjunction with the accompanying drawings, which illustrate, by way of example, the principles of the presently described embodiments.

DETAILED DESCRIPTION OF THE DRAWINGS

Figure 1:
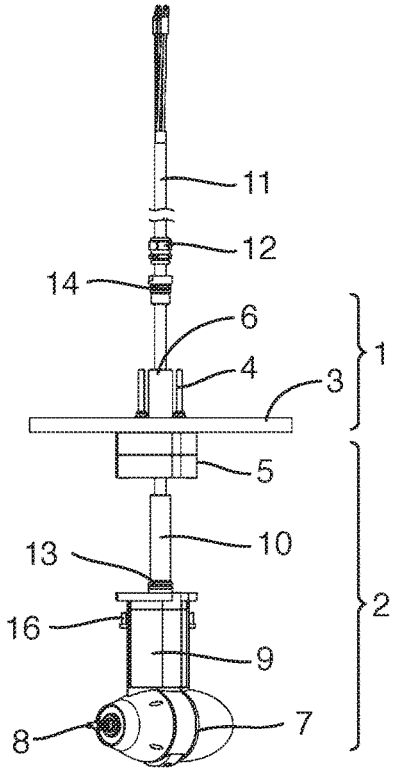
FIG. 1 shows a side plan view of a boat drive according to at least one embodiment.

The above described drawing figures illustrate the described invention in at least one embodiment, which is further defined in detail in the following description. Those having ordinary skill in the art may be able to make alterations and modifications to what is described herein without departing from its spirit and scope. While the disclosure is susceptible of embodiment in many different forms, there is shown in the drawings and will herein be described in detail at least one embodiment of the invention with the understanding that the present disclosure is to be considered as an exemplification of the principles of the invention and is not intended to limit the broad aspect of the disclosure to the embodiment illustrated. Therefore, it should be understood that what is illustrated is set forth only for the purposes of example and should not be taken as a limitation on the scope of the present disclosure.

Figure 2:
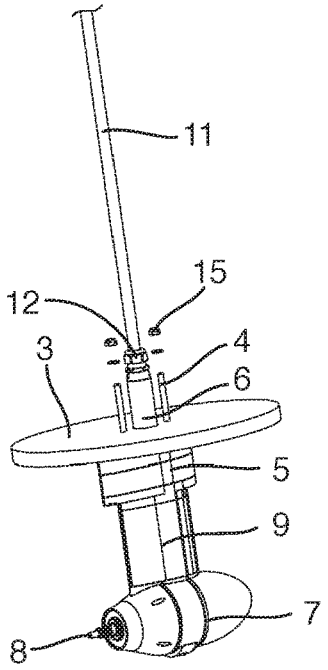
FIG. 2 shows a top perspective view of a boat drive according to at least one embodiment.
Figure 3:
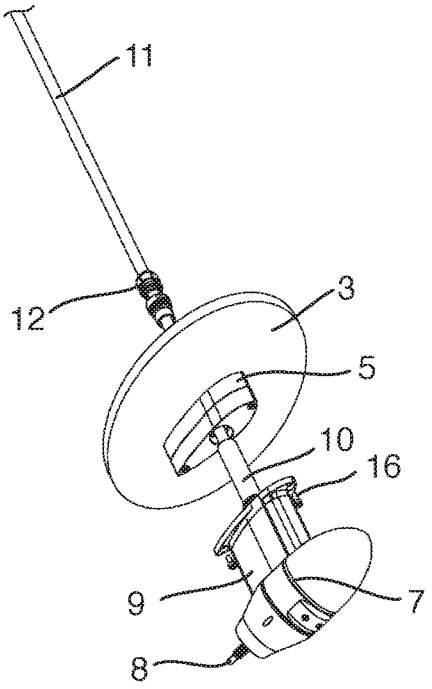
FIG. 3 shows a bottom perspective view of a boat drive according to at least one embodiment.

Referring to FIGS. 1-3, a boat drive consists of a first part 1 fixedly attached to the boat, and a second detachable part 2. The first part 1 is screwed to the bottom 3 of the boat hull. In the bottom 3 a central hole, through which the outer tube (see below) can pass, and for example two additional holes are drilled. Bolts are passed through the additional holes in order to attach a mounting body 5 to the bottom 3. Any gap between the mounting body 5 and the bottom 3 is sealed with sealing agent and/or adhesive. An adaptable part, formed for example from plastic, can also be provided.

In at least one embodiment, the mounting body 5 is disposed outside the boat hull. It is however equally possible to provide the mounting body in the interior of the boat hull, and to pass the bolts or screws for attaching the mounting body from the interior of the boat outwards through the bottom 3.

An outer tube 6 is attached to the mounting body 5 and passes through the bottom 3 via the central drilled hole described above. The outer tube 6 is attached in a waterproof manner to the mounting body 5. For example, the outer tube 6 is attached to the mounting body 5 by means of a welded, screwed or bonded connection. In every case, after attachment of the mounting body 5 to the bottom 3, the interior of the outer tube 6 is the only connection between the interior of the boat and the exterior of the boat hull. Aside from this, the interior of the boat and the exterior of the boat hull are separated from each other in a waterproof manner.

The second part of the boat drive comprises an underwater pod 7, in which an electric motor (not shown) is disposed. The electric motor drives a drive shaft 8, to which, outside the underwater pod 7, a propeller is attached. For reasons of clarity the propeller is also not shown.

A spacer 9 is connected to the underwater pod 7. The spacer 9 has a continuous hollow space with which an inner tube 10 is connected, or into which an inner tube 10 is inserted. In the outer wall of the underwater pod 7, an aperture is provided which creates a connection between the interior of the underwater pod 7 and the interior of the inner tube 10. The underwater pod 7, the spacer 9 and the inner tube 10 are otherwise connected with each other in a waterproof manner.

One or more electrically conductive cables 11 are attached to the electric motor. The cables 11 can be disconnected by means of a plug connection 12.

The first and second parts 1, 2 of the boat drive are connected to each other in that the inner tube 10 is inserted in the outer tube 6. The sealing between the inner tube 10 and the outer tube 6 is achieved by means of O-rings 13, 14. After the inner tube 10 and the outer tube 6 are put together, O-rings 13, 14 are disposed between the two tubes 10, 6, and are compressed in a radial direction. By this means the gap between the inner tube 10 and the outer tube 6 is sealed.

It is expedient to provide one or more grooves, each of which accommodates one O-ring, around the circumference of the inner tube 10 and/or the outer tube 6, either on the outside of the inner tube 10 or on the inside of the outer tube 6.

The inner tube 10 and the outer tube 6 are preferably sealed against each other, in each case at their end which faces towards the underwater pod, by means of one or two O-rings 13. In addition, the inner tube 10 and the outer tube 6 are preferably sealed against each other, in each case at their end which faces away from the underwater pod, by means of one or two O-rings 14. The term "ends" refers here in particular to the third, fourth, fifth, eighth or tenth part of the length of the inner tube 10 and/or the outer tube 6 in each case.

FIG. 2 shows the boat drive according to at least one embodiment in the assembled state. For the purposes of repair or inspection of the underwater pod 7, the electric motor, the propeller, or another element or component that is disposed in the underwater pod, the second part 2 of the boat drive can be detached from the boat.

For this purpose, both screws 16 are released. The plug connection 12 is also released and the electric cable 11 is disconnected. The second part 2 of the boat drive thereby remains inserted in the outer tube 2 only, and can simply be pulled out downwards.

The assembly of the boat drive accordingly takes place in the reverse sequence. First the inner tube 10 is inserted in the outer tube 6. Due to the radial sealing by means of the O-rings 13,14 according to the invention, it is not necessary to keep the inner tube 10 and the outer tube 6 in a precise position relative to each other in an axial direction. The seal between the inner tube 10 and the outer tube 6 exists over a wide range, namely as long as at least one of the O-rings 13, 14 is disposed between the two tubes 10, 6.

After the two parts 1, 2 have been pushed together, it is only necessary in addition to secure the lower, second part 2 of the boat drive against falling out. For this purpose the screws 16 are screwed into the mounting body 5. Electrical connection of the electric motor is achieved by connecting the plug connection 12.

Both assembly and disassembly of the boat drive are easy to accomplish, and can also be carried out by a non-specialist. In particular, no danger of leakage exists following disassembly and subsequent reassembly of the boat drive.

The enablements described in detail above are considered critical to the operation of at least one aspect of the invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the claimed subject matter is what is intended to be patented.

What is claimed is:

1. A boat drive for a boat having a boat hull with a bottom, the boat drive comprising:

an underwater pod;

an electric motor disposed in the underwater pod, the electric motor driving, via a drive shaft, a propeller attached to the underwater pod;

an electrical supply line for supplying energy to the electric motor;

an inner tube connected to the underwater pod and displaceably disposed in an outer tube, wherein the electrical supply line is routed through the inner tube;

a mounting body designed to be detachably attached to a bottom-exterior surface of the boat hull such that a horizontal contact surface is formed between a substantially horizontal region of the bottom-exterior surface of the boat hull and a substantially horizontal upper surface of the mounting body, wherein the outer tube is passed through the mounting body;

at least one annular sealing element disposed between the inner and outer tubes, wherein the at least one annular sealing element seals the inner tube and the outer tube in a radial direction relative to the longitudinal axis of the inner tube; and a securing element located below the bottom of the boat hull attaching the underwater pod to the mounting body.

2. The boat drive of claim 1, wherein the at least one annular sealing element is an O-ring.

3. The boat drive of claim 1, wherein the at least one annular sealing element comprises two or more sealing elements.

4. The boat drive of claim 3, wherein the at least one annular sealing element comprises four sealing elements.

5. The boat drive of claim 3, wherein the outer tube comprises a first end and a second end, and at least one of the sealing elements is in contact with the first end and at least one of the sealing elements is in contact with the second end.

6. The boat drive of claim 5, wherein the first end and the second end comprise in each case a third, a fourth, a fifth, an eighth or a tenth part of the length of the outer tube.

7. The boat drive of claim 1, wherein the electrical supply line includes a plug connection.

8. The boat drive of claim 1, further comprising a spacer disposed between the underwater pod and the inner tube.

9. The boat drive of claim 1, wherein the mounting body is attached in a waterproof manner to the bottom-exterior surface of the boat hull.

10. The boat drive of claim 9, wherein the mounting body is at least in part disposed inside the boat hull.

11. The boat drive of claim 9, wherein the mounting body is at least partially disposed outside the boat hull.

12. The boat drive of claim 9, wherein the mounting body is attached to the bottom of the boat hull by means of screwed connections, and the mounting body and the bottom of the boat hull are sealed by means of a sealing agent.

13. The boat drive of claim 9, wherein the outer tube is closed by a closing element which is sealed by the at least one annular sealing element.

14. The boat drive of claim 9, wherein the underwater pod together with the inner tube is mounted so as to pivot relative to the mounting body and the outer tube.

* * * * *